United States Patent [19]

Girault et al.

[11] Patent Number: 5,048,855

[45] Date of Patent: Sep. 17, 1991

[54] SKI BINDING APPARATUS AND BEARING INSERT THEREFOR

[75] Inventors: Eric Girault, Seynod; Paul Arnulf, Alby Sur Cheran, both of France

[73] Assignee: Salomon S.A., Annecy Cedex, France

[21] Appl. No.: 507,880

[22] Filed: Apr. 12, 1990

[30] Foreign Application Priority Data

Apr. 12, 1989 [FR] France ..... 89 05168

[51] Int. Cl.[5] ..... A63C 9/10

[52] U.S. Cl. ..... 280/615; 280/632

[58] Field of Search ..... 280/611, 613, 614, 615, 280/631, 632

[56] References Cited

U.S. PATENT DOCUMENTS

| | | | |
|---|---|---|---|
| 4,484,762 | 11/1984 | Salomon | 280/615 |
| 4,496,169 | 1/1985 | Salomon et al. | 280/615 |
| 4,553,771 | 11/1985 | Bernard et al. | 280/615 |
| 4,613,150 | 9/1986 | Cooper | 280/615 |
| 4,768,804 | 9/1988 | With | 280/614 |
| 4,842,294 | 6/1989 | Makarenko | 280/615 |
| 4,948,158 | 8/1990 | Makarenko | 280/615 |

FOREIGN PATENT DOCUMENTS

| | | | |
|---|---|---|---|
| 3528923 | 3/1986 | Fed. Rep. of Germany | 280/615 |
| 2537011 | 6/1984 | France . | |
| 2598927 | 11/1987 | France | 280/615 |
| 0235558 | 5/1986 | German Democratic Rep. | 280/615 |
| 85/05557 | 12/1985 | World Int. Prop. O. . | |

*Primary Examiner*—Andres Kashnikow
*Assistant Examiner*—Brian L. Johnson
*Attorney, Agent, or Firm*—Sandler, Greenblum & Bernstein

[57] ABSTRACT

A binding apparatus for affixing a cross-country ski shoe to a ski, for a shoe having at a front end a transverse hinge pin, and a bearing insert for the hinge pin. The apparatus includes a bearing housing having an inner surface and an opening positioned upwardly with respect to the ski for receiving the hinge pin. A member is provided which is movable from a retracted position to a position above the opening of the housing for retaining the hinge pin within the housing, and an insert affixed to the housing inner surface for increasing the area of the housing inner surface against which forces from the hinge pin are transmitted during skiing. Particular forms of the insert are provided and the insert includes shapes which particularly adapt the insert for being embedded within the housing.

59 Claims, 4 Drawing Sheets

Fig- 1
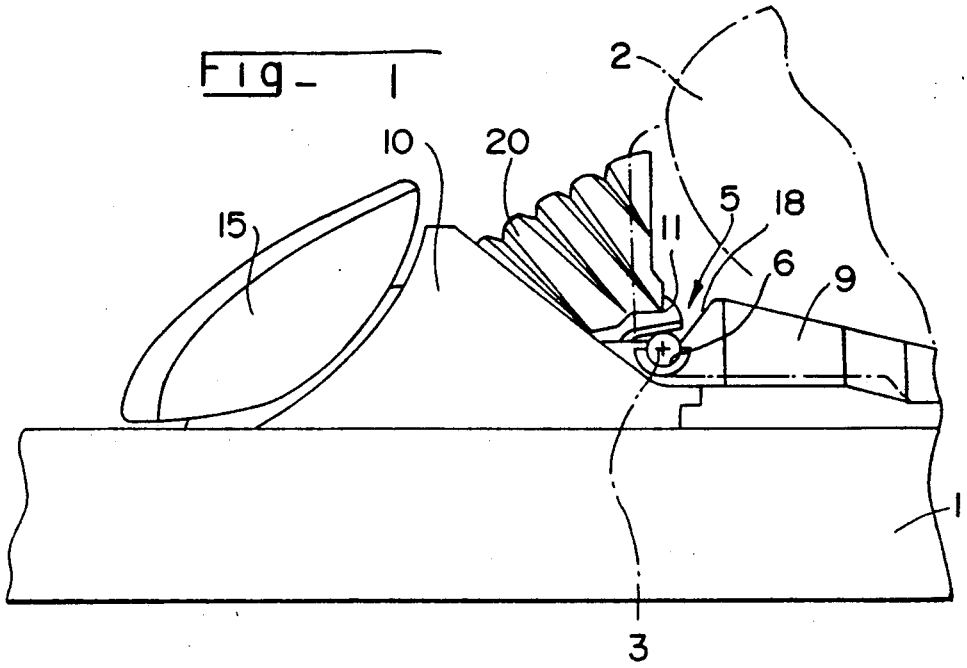
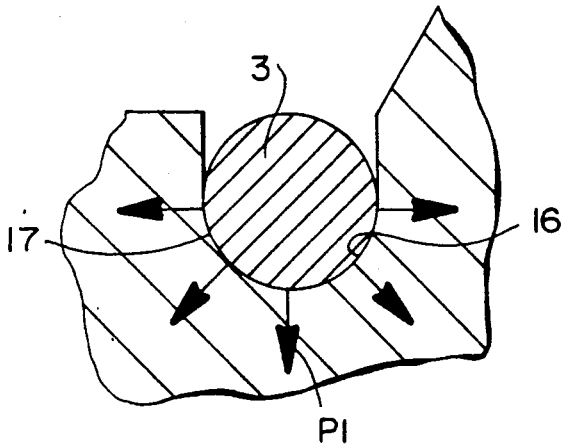
Fig- 2
PRIOR ART
Fig- 3
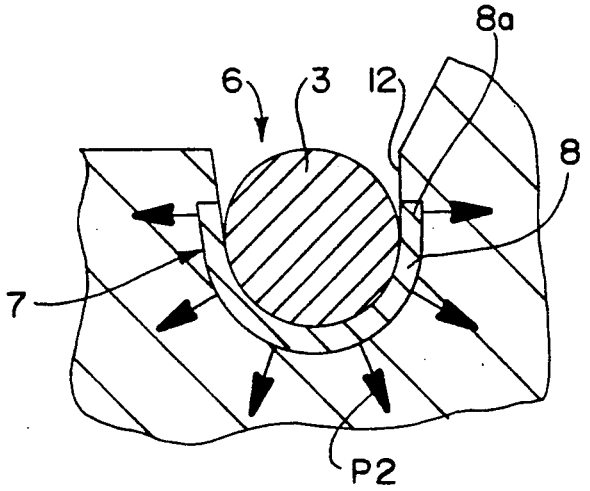
Fig- 4
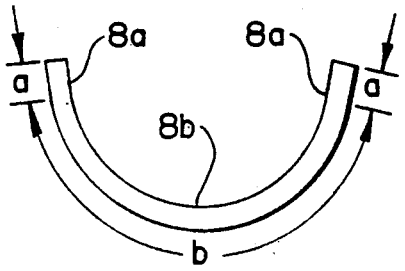

SKI BINDING APPARATUS AND BEARING INSERT THEREFOR

BACKGROUND OF THE INVENTION

1. Field of the Invention

The present invention relates to a ski binding, preferably for affixing the front of a cross-country shoe to a ski. More particularly, the apparatus of the present invention includes, for a frontwardly mounted transverse hinge pin of a ski shoe, a housing which is upwardly open for receiving the hinge pin, and a bearing insert therefor. Further, the present invention concerns a binding apparatus which includes an upwardly open housing, or bearing, upwardly open for the hinge pin of the shoe, and a moveable plate or bar, intended for the closure of the housing, and the clamping of the hinge pin, while allowing rotation of the shoe around the axis of the hinge pin.

2. Description of Background and Other Information

The constraints of lightness, essential in the field of cross-country skiing, as well as ease of construction, reduction in the number of pieces, and cost lead to an apparatus in which the housing for the hinge pin of the shoe for a binding of the above-described type is in a fixed part of the apparatus which includes the seat, which is generally made of a synthetic molded material.

Such an embodiment formed from synthetic material is, in principal, normally sufficient for cross-country skiing, the stress produced being of relatively little importance.

However, due to the occurrence of wear, particularly due to the difference in hardness between the materials and of the relatively small diameter of the hinge pin, which leads to an increased pressure in the base portion of the hinge pin in its bearing, wear is even more accentuated by the fact that the housing of the pin is generally made of two bearings found at each of the ends of the pin.

An additional wear of about the same magnitude occurs due to the presence of particles, such as sand or other foreign matter, being lodged between the pin and its bearing, which can have a strong abrasive effect.

SUMMARY OF THE INVENTION

In view of the above, it is an object of the invention to overcome the disadvantages mentioned above by providing a binding apparatus, and a bearing insert therefor, for affixing a cross-country ski shoe to a ski, in which the shoe has a front transverse hinge pin, the apparatus including:

a bearing housing having an inner surface and an opening positioned upwardly with respect to the ski for receiving the hinge pin;

a member movable from a retracted position to a position above the opening of the housing for retaining the hinge pin within the housing; and an insert affixed to the housing inner surface for increasing the area of the housing inner surface against which forces from the hinge pin are transmitted during skiing.

According to a preferred embodiment, the insert has a semi-cylindrical form which is upwardly open.

Further according to a preferred embodiment, the insert extends generally along the entire length of the hinge pin.

Still further, the insert extends in a longitudinal direction generally along a greater arc of a circle than the contact area between the insert and the hinge pin.

In a still further embodiment of the invention, the housing is made from a synthetic material in a piece adapted to be fixed with respect to the ski.

In a still further embodiment of the invention, the insert is made from a synthetic material having a greater hardness than that of said housing. In a particular embodiment the insert is metallic. The insert could be provided in the form of a molded member formed from a casting.

In a still further embodiment, the insert is interchangeable.

In an alternative embodiment, the insert is affixed to the housing by welding.

It is another object of the invention to provide a binding apparatus for affixing a cross-country ski shoe to a ski, for a shoe having at a front end a transverse hinge pin having a predetermined radius of curvature, the apparatus including:

a bearing housing having a transversely extending generally arcuate inner surface and an opening positioned upwardly with respect to the ski for receiving the hinge pin, the generally arcuate inner surface of the bearing housing being recessed by a predetermined amount greater than the radius of curvature of the hinge pin; and an insert having a generally arcuate inner surface, at least a portion of the inner surface having a radius of curvature generally equal to the predetermined radius of curvature of the hinge pin, the insert having a width generally equal to the predetermined amount by which the bearing housing is recessed, and being affixed to the inner surface of the bearing housing. Means are preferably provided for retaining the hinge pin within the housing.

According to a further aspect of the invention, the bearing housing further includes a non-recessed portion having an inner surface, and the generally arcuate inner surface of the insert is generally flush with the inner surface of the non-recessed portion of the bearing housing.

According to another aspect of the invention, the arcuate inner surface of the insert portion extends from a forward zone to a rearward zone, and the insert further includes a generally planar portion extending upwardly beyond the forward zone and a generally planar portion extending upwardly beyond the rearward zone.

In one embodiment, the arcuate inner surface of the insert portion extends for approximately 180 degrees.

In another embodiment, the arcuate inner surface of the insert portion extends for less than 180 degrees.

The particular configuration of the bearing insert is a further object of the invention. In a particular embodiment of the invention, the bearing insert is adapted to be received within a housing, wherein the insert includes a transversely extending generally arcuate inner surface and means for anchoring the bearing insert within the housing.

In an additional aspect of the invention, the insert includes an arc extending longitudinally from a forward end portion to a rearward end portion, and the forward end portion includes a recess therein.

In a preferred embodiment, the recess in the forward end portion of the insert is a generally longitudinally centered, laterally extending cut-out.

In a further aspect of the invention, the insert includes a part which extends rearwardly and which is embedded within the housing.

In a preferred embodiment, the rearwardly extending part is generally T-shaped.

In a still further aspect of the invention, the insert includes an arc extending longitudinally from a forward end portion to a rearward end portion, and the insert includes a part which extends rearwardly from the rearward end portion and which is embedded within the housing.

In a still further aspect of the invention, the insert includes an arc extending longitudinally from a forward end portion to a rearward end portion and further includes a pair of lateral wings extending generally rearwardly from the rearward end portion.

In a particular embodiment of the invention, the lateral wings are generally hook-shaped.

In another embodiment of the invention, the lateral wings extend at an incline, rearwardly and upwardly. Preferably, the lateral wings are embedded within at least a portion of the ramp and extends at least partially along the ramp.

In another aspect of the invention, the forward end of the insert includes at least one laterally extending depression. Preferably, the at least one laterally extending depression includes a pair of laterally centered laterally extending depressions.

In an additional aspect of the invention, the insert includes a pair of lateral ends, and further including recesses within the ends.

In a still additional aspect of the invention, the insert has an outer surface having a plurality of laterally spaced depressions therein. In a preferred embodiment, the insert further includes a plurality of ribs projecting from the inner surface of the insert, wherein each of the ribs correspond to a respective one of the depressions.

BRIEF DESCRIPTION OF THE DRAWINGS

The above and additional objects, characteristics, and advantages of the present invention will become apparent in the following detailed description of a preferred embodiment, with reference to the accompanying drawings which are presented as a non-limiting example, in which:

FIG. 1 is a side elevation view of an mounting device using an insert according to the invention;

FIG. 2 is a longitudinal cross-sectional view of an axis housing of the prior art;

FIG. 3 is a view similar to that of FIG. 2 of a pin housing according to the invention;

FIG. 4 is an end view of the insert;

DETAILED DESCRIPTION OF PREFERRED EMBODIMENTS

Figure 5:
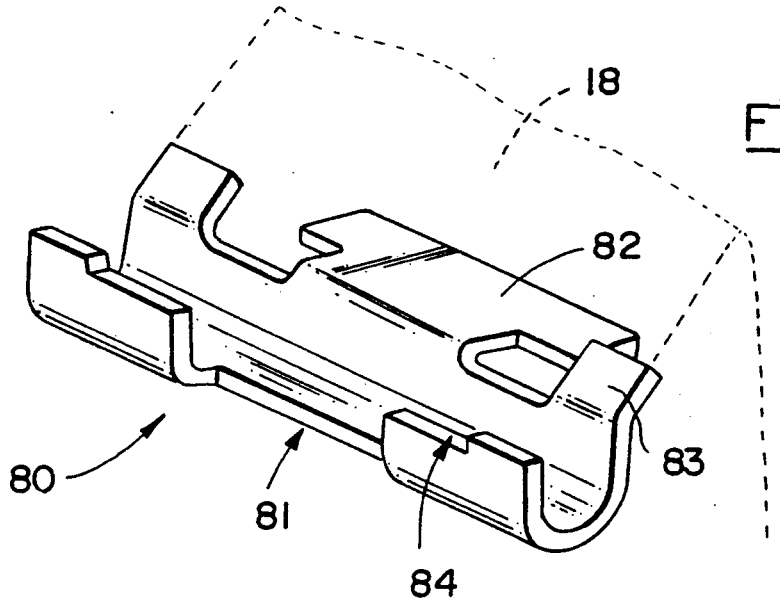
FIG. 5 is a perspective view of a first modified embodiment of the invention.

The present invention has, as an objective, to provide a housing covered by an insert intended to increase the bearing surface on the surface of the housing for the hinge pin of the ski shoe. The insert generally extends along the entire length of the hinge pin, and the housing is made of synthetic material on a fixed piece of the apparatus.

The present invention is directed to a "hinged" type of binding apparatus for a cross-country ski shoe which has affixed, at its front end, a transverse hinge pin.

In such an apparatus, the mounting of the shoe to the ski is accomplished by the intermediary of the hinge pin, which is clamped by the apparatus, while allowing rotation about the axis of the pin with respect to the ski, thereby providing the aforementioned "hinged" connection for the apparatus.

An objective of the present invention is to remedy the disadvantages associated with the prior art and to provide a binding apparatus of the above-mentioned type, i.e., using for the hinge pin of the shoe a housing open towards the top and a moveable bar intended for the sealing or closing of the housing, which conciliates the needs of lightness, cost, and a decrease in the number of pieces of the bearing having wear problems, and which particularly permits the use of synthetic materials for such a bearing.

The above-mentioned objective is attained in the apparatus according to the invention by the fact that the housing is covered by an insert intended to increase the bearing surface of the axis on the surface of the housing. Indeed, the increase of the bearing surface for the hinge pin on the housing allows a reduction in the pressure exerting itself on the housing, and which permits the housing to be made from a material of lesser hardness.

According to a preferred embodiment, the housing is made from a synthetic material in a fixed piece of the apparatus, which does not, therefore, require the creation of any additional piece.

The insert can be made from a synthetic material having a greater hardness than that from which the housing is made. Further, the insert can be metallic. Further, the insert is preferably integrated into the housing, e.g., by molding from a casting, during the manufacture of the housing.

Alternatively, the insert can be made to be more easily interchangeable, and can be affixed to the housing after the fabrication of the housing, by any appropriate means which would permit replacement of the insert by the user in the case of premature wear. For example, the insert could be replaceably affixed to the housing by screwing, clipping, embedding, gluing, or welding.

With specific reference to the drawing, FIG. 1 represents a binding apparatus of the hinged type, that is, it is designed to ensure the rotative mounting of a shoe 2 (shown in phantom lines in the drawing) to a ski 1 by the intermediary of a hinge pin 3, or bight, extending transversely to the longitudinal axis of the ski, and affixed to the front of the shoe 2.

The binding apparatus is essentially a clamping assembly 5 for the hinge pin 3 of the shoe, mounted in a body 10 having a locking lever 15 and an elastic stress absorber 20 for the tip of the shoe.

In the embodiment shown, the clamping assembly 5 comprises a fixed housing 6, intended to receive the hinge pin 3 of the shoe and which is upwardly open for this purpose, although the housing could be made to face in any direction that would allow the introduction and removal of the hinge pin 3. As shown in FIG. 1, a ramp 18 is provided which guides the hinge pin 3 toward the housing as the shoe is secured to the binding apparatus. A movable plate or bar 11 is provided which is designed to seal or close the housing 6 for the clamping the hinge pin 3 inside of the housing. The body 10, within which the housing 6 is recessed, is made of a synthetic material. Further, body 10 is mounted forwardly of a longitudinally extending rib 9, which is typically provided for mating with a complementary groove provided in at least a forward portion of the sole of the ski shoe. If desired, the body could be made integral with the rib 9.

The specific operation of bar 11 does not enter into the context of the present invention and its manner of movement is not limited to a particular form. Generally, the bar 11 is designed to slide, pivot, or otherwise move from a position retracted from the housing 6, to a retention position overlying the housing by downward pressure being exerted on locking lever 15, for example. Nevertheless, to the extent necessary to ensure a complete understanding of the invention, the subject matter of copending commonly assigned U.S. application Ser. No. 07/359,486, filed May 31, 1989, is hereby incorporated by reference for the purpose of disclosing a ski binding apparatus for which the present invention can be incorporated.

FIG. 2 shows the usual configuration of a housing for the hinge pin of the shoe. Such a housing generally comprises two cavities or supports 16, located at the ends of the hinge pin, and has in the cross-section shown in the FIG. 2 embodiment, a U-shape of complementary dimensions to that of the hinge pin, the supports 16 being simply made by molding in one of the fixed pieces of the apparatus.

As is shown in FIG. 2, the stresses exerting themselves on the hinge pin 3 are transmitted to each support 16 by the biasing of the contact surface 17 between the axis 3 and the respective support 16.

Such a contact surface 17 is generally of a semi-cylindrical shape and extends in a longitudinal direction along about one-half of a circle whose diameter corresponds to the external diameter of the hinge pin 3, as is shown in FIG. 2. Such a contact surface 17 is therefore limited, even more than the length of the bearing in the transverse direction.

There results on each of the contact surfaces 17 a pressure P1 which is relatively high and which is not easily compatible with an embodiment utilizing synthetic materials.

In the apparatus of the present invention, on the contrary, housing 6 for the hinge pin 3 is covered by an insert 8, such that the area of the bearing surface 7 of the body 10 for the hinge pin 3 corresponds to the area of the exterior surface of the insert 8 and is, therefore, necessarily greater due to the thickness of the insert.

The bearing surface 7 extends indeed in a longitudinal direction (or in profile) along an arc of a circle having a diameter equal to that of the hinge pin 3, increased by the double thickness of insert 8.

There necessarily results, on body 10, which includes the housing 6, a pressure P2 less significant than pressure P1 and which is compatible for use for the body made from synthetic material.

Further, according to a preferred embodiment, the housing or cavity 6 has a semi-cylindrical form, and extends along the entire length of the hinge pin 3, the same as insert 8. Such a housing, without the insert, is disclosed, for example, in commonly assigned copending U.S. application Ser. No. 07/359,486, referred to above, and which is hereby incorporated by reference for this purpose. There results, because of this form of the housing and insert, an increase in the contact surface 7 between housing 6 and insert 8 and, consequently, a lessening of the pressure exerting itself on this contact surface.

It can be noted, as shown in FIG. 3, that insert 8, by means of portions **8*a*, extends somewhat beyond an arc of a circle, whether 180 degrees, or more or less than 180 degrees, and, therefore, the insert includes a surface greater than its normal zone of contact with the hinge pin 3, which permits the insert 8** to take into account the stress exerted on the axis in a longitudinal direction, for example, in case of "twisting" of the shoe relative to the longitudinal axis of the shoe and ski, to provide a bearing surface for the pin during the occurrence of such forces.

This also has the effect of increasing the contact surface between insert 8 and housing 6, to which the stress exerting itself on the hinge pin will be transmitted and, therefore, this has the effect of reducing even more the pressure exerting itself on the hinge pin. The presence of insert 8 further allows a reduction of the movement of the synthetic material making up body 10 and, therefore, an increase in its longevity in the housing area of axis 6.

Further, the two upper rims of **8*a* of insert 8 are slightly widened towards the outside and meet, therefore, at insert 8** generally in the form of a U to facilitate the introduction of the hinge pin.

The bearing housing 6 provided in the longitudinally extending projection 9 has a transversely extending generally arcuate non-recessed inner surface 12. The aforementioned bearing surface 7 of the housing 6 is recessed within the surface 12 by a predetermined amount greater than the radius of curvature of the hinge pin 3.

As shown in FIG. 4, the insert 8 has a generally arcuate portion **8*b* having an inner surface that extends through distance b and portions 8*a* having generally planar surfaces which extend through respective distances a. The inner surface of portion 8*b* has a radius of curvature generally equal to the predetermined radius of curvature of the hinge pin 3. Further, the insert 8** has a width generally equal to the predetermined amount by which the bearing housing is recessed.

The respective inner surfaces of the ends of the insert, specifically the inner surface of rims **8*a* in the embodiment shown in FIGS. 3 and 4, are generally flush with the inner surface 12 of the non-recessed portion of the bearing housing. The arcuate inner surface of portion 8*b* of the insert 8 extends from a forward zone to a rearward zone. The portions 8*a*** extend upwardly beyond the forward and rearward zones of the arcuate portion, as mentioned above.

In one embodiment, the arcuate inner surface of the insert portion 8b extends for approximately 180 degrees, as shown in FIG. 1. In another embodiment, the arcuate inner surface 8b of the insert portion extends for less than 180 degrees, as shown in FIG. 4.

By means of the insert described above, an embodiment of housing 6 for the hinge pin 3 is provided in one of the fixed pieces of the ski binding apparatus which is made of synthetic material, as it is in body 10, without the risk of premature rupture or of harm to the body, and without the need of a special metallic piece.

Such an insert 8 can be embodied in a synthetic material harder than that of body 10 or, alternatively, in a metallic material in a manner to be less prone to problems of wear at the area of its contact with the hinge pin.

The insert can be integrated in the body 10 by molding from a casting or can be affixed to the body 10 after molding, for example, by welding.

Additionally, the insert can be designed to be interchangeable in a manner to be replaced in case of premature wear.

In the embodiment illustrated in FIG. 5, an insert 80 is shown, which is somewhat modified compared to insert 8, described above. Specifically, a cut-out 81 is preferably provided in a laterally central portion of one of the upwardly projecting portions, which generally corresponds to one of portions 8a in the embodiment described above. In this preferred embodiment, the recess or cut-out 81 is formed in the forwardly positioned portion of the insert 80, with regard to the ski and the position of the shoe to which the binding is to be affixed, i.e., in the leftmost portion in FIG. 1.

Figure 10:
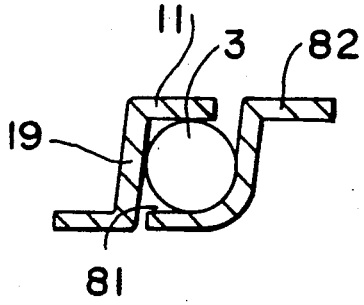
FIG. 10 is a transverse cross-sectional view of the embodiment of FIG. 5 in which the hinge pin is received within the housing and the movable plate is positioned above the hinge pin, latching the hinge pin within the housing.

One purpose of the recess 81 is to provide a passage for the movable plate 11 to enable the plate 11 to move closer to the hinge pin 3, as shown in FIG. 10, and for a greater range of adjustment between the hinge pin and the movable plate. FIG. 10, which is a cross-sectional view taken along a central longitudinal plane through insert 80, shows the plate 11 having a downwardly extending portion 19, which is positionable within the recess 81, as the hinge pin 3 is positioned in the latched positioned of the binding apparatus, to more securely hold the hinge pin in place.

An additional purpose of the recess 81 is to facilitate the centering of the insert in the mold of the housing 10, thereby improving the accuracy of the completed assembly after molding. The completed assembly of housing and insert 80 will include a quantity of plastic, from which the housing is molded, within a portion of the recess 81, to the level of the lower inner surface of the insert 80, as shown in FIG. 7, as reference numeral 60.

Figure 7:
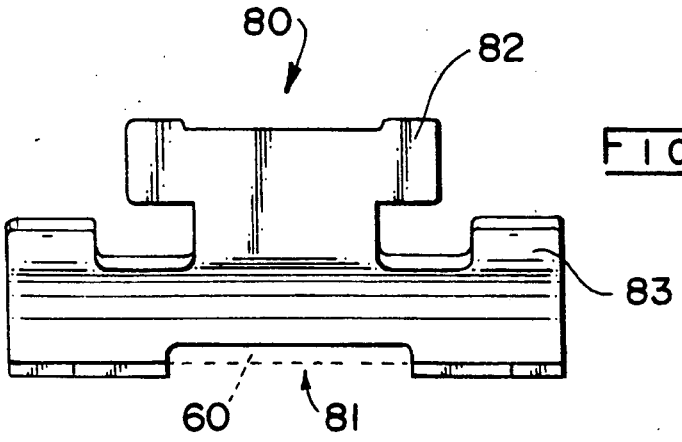
FIG. 7 is a plan view of the embodiment of FIG. 5.
Figure 8:
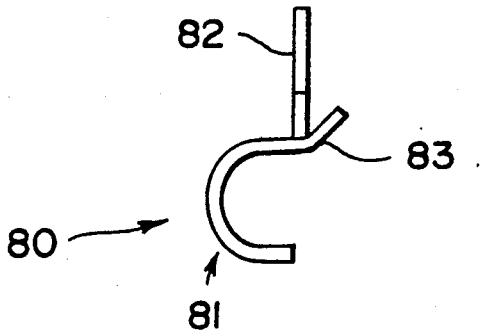
FIG. 8 is a side elevation view of the embodiment of FIG. 5.

In addition, a rearwardly extending T-shaped part 82 is provided, which extends from the rear upwardly extending portion of the insert 80, as shown in the side view of FIG. 7 and the side view of FIG. 8. In the completed assembly of housing and insert, part 82 extends within the molded housing to provide for a better anchoring therewithin.

Figure 9:
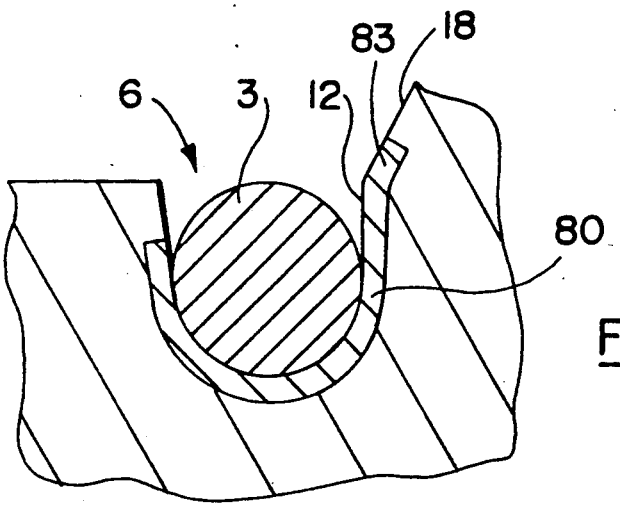
FIG. 9 illustrates, in a view similar to that of FIG. 3, the insert of the embodiment of FIG. 5 positioned within the housing.

Further, a pair of lateral wings 83 are provided for protecting the housing against wear, particularly when the hinge pin 3 exerts pressure against the portion of the housing in the vicinity of the wings 83, due to torsional movement of the foot and during insertion and removal of the hinge pin 3 during insertion and removal of the shoe from the binding apparatus. As shown in FIG. 9, the lateral wings 83 extend at least partially along the ramp 18 for guiding the hinge pin 3 into the insert 80. Further, as shown in FIG. 5, the lateral wings 83 are embedded within the ramp 18, as shown in broken lines in FIG. 5.

Figure 6:
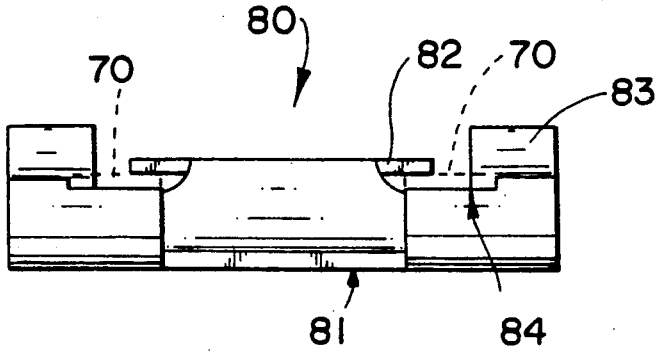
FIG. 6 is a front elevation view of the embodiment of FIG. 5.

Still further, lateral depressions 84 are provided for improving the anchoring of the insert 80 into the housing. In this regard, similar to that which is described above in connection with FIG. 7 and reference numeral 60, a certain amount of molded plastic is formed at locations 70, which extends within the thickness of the insert 80, to the inner surface thereof, as shown in FIG. 6.

Figure 11:
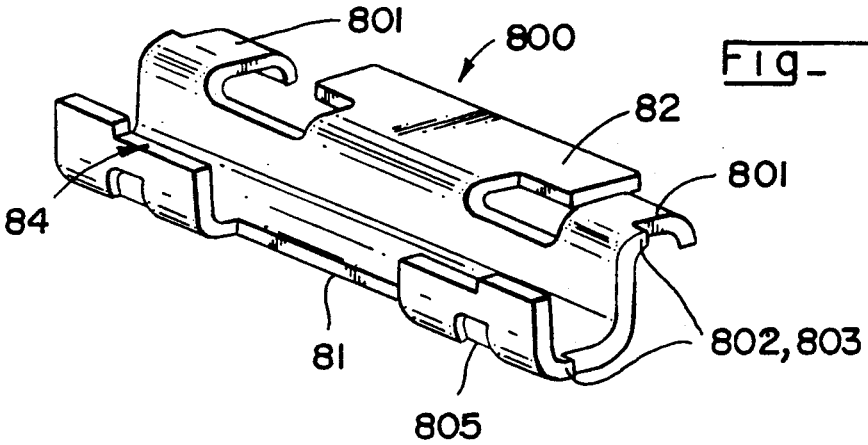
FIG. 11 is a perspective view of a second modified embodiment of the invention.
Figure 12:
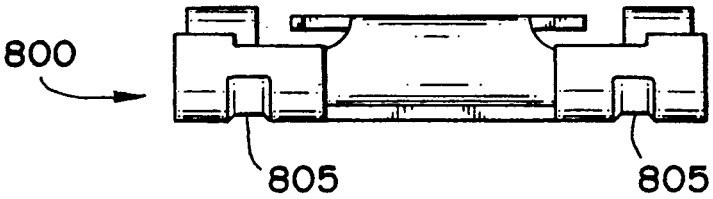
FIG. 12 is a front elevation view of a second modified embodiment of the invention.

In the embodiment illustrated in FIG. 11, an insert 800 is shown, which is modified slightly from the insert of FIG. 5. Insert 800 includes a cut-out or recess 81, as in the embodiment of FIG. 5, as well as the T-shaped part 82, and lateral depressions 84.

Figure 14:
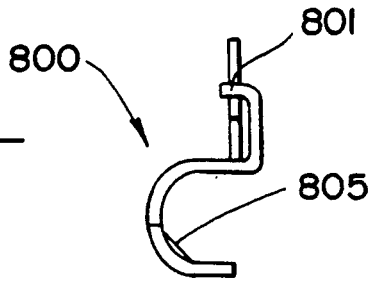
FIG. 14 is a side elevation view of the embodiment of FIG. 11.

On the other hand, as shown in FIGS. 11 and 14, in particular, instead of the lateral wings 83 of the first modified embodiment of FIG. 5, insert 800 includes two rearwardly extending lateral hook-shaped wings 801, which serve to improve the anchoring of the insert 800 within the housing.

Figure 13:
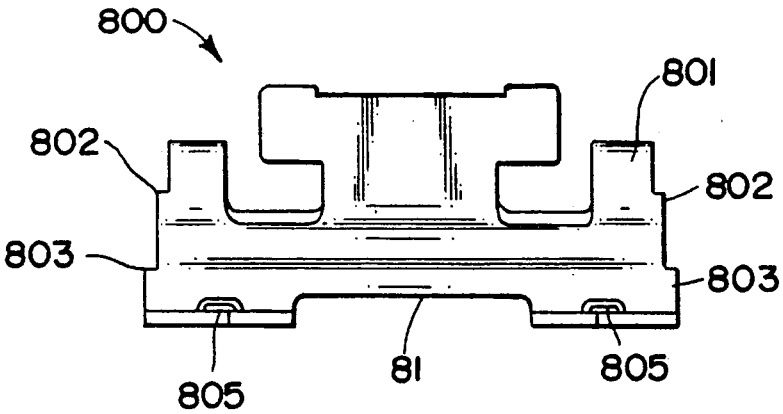
FIG. 13 is a plan view of the embodiment of FIG. 11.

Similarly, recesses or indentations 802, 803 are provided on the lateral ends of the insert 800, as shown in FIGS. 11 and 13, to increase the anchoring thereof still further. Indentations 802, 803 serve to laterally and longitudinally secure the insert 800 within the housing.

As shown in FIGS. 11–14, a pair of laterally spaced depressions 805 made within the outer surface of the insert 800, which can be provided to strengthen, i.e., stiffen, the insert. In the end view of FIG. 14, it can be seen that the depressions preferably form ribs extending from the inner surface of the insert 800.

Finally, although the invention has been described with reference of particular means, materials and embodiments, it is to be understood that the invention is not limited to the particulars disclosed and extends to all equivalents within the scope of the claims.

What is claimed is:

1. A binding apparatus for affixing a cross-country ski shoe to a ski, the binding apparatus having a longitudinal direction, the shoe having mounted at a front end thereof a hinge pin extending transversely to the longitudinal direction, said hinge pin having a predetermined length, said apparatus comprising:

a bearing housing adapted to be mounted on an upper surface of the ski, said bearing housing having an inner surface and an opening positioned upwardly with respect to the ski for receiving said hinge pin;

a member movable from a retracted position to a position above said opening of said housing for retaining said hinge pin within said housing; and an insert affixed to said housing inner surface for receiving and contacting said hinge pin along a contact area, and for increasing the area of said housing inner surface against which forces from said hinge pin are transmitted during skiing.

2. The binding apparatus of claim 1, wherein said insert has a generally semi-cylindrical form which is upwardly open.

3. The binding apparatus of claim 1, wherein said insert extends generally along the entire length of said hinge pin.

4. The binding apparatus of claim 2, wherein said insert extends generally along the entire length of said hinge pin.

5. The binding apparatus of claim 1, wherein said insert extends in the longitudinal direction generally along a greater arc of a circle than the contact area between said insert and said hinge pin.

6. The binding apparatus of claim 2, wherein said insert extends in the longitudinal direction generally along a greater arc of a circle than the contact area between said insert and said hinge pin.

7. The binding apparatus of claim 3, wherein said insert extends in the longitudinal direction generally along a greater arc of a circle than the contact area between said insert and said hinge pin.

8. The binding apparatus of claim 4, wherein said insert extends in the longitudinal direction generally along a greater arc of a circle than the contact area between said insert and said hinge pin.

9. The binding apparatus of claim 1, wherein said housing is made from a synthetic material in a piece adapted to be fixed with respect to the ski.

10. The binding apparatus of claim 9, wherein said insert is made from a synthetic material having a greater hardness than that of said housing.

11. The binding apparatus of claim 9, wherein said insert is metallic.

12. The binding apparatus of claim 9, wherein said insert comprises a member molded with said housing.

13. The binding apparatus of claim 11, wherein said insert comprises a member molded with said housing.

14. The binding apparatus of claim 9, wherein said insert comprises a member separate from said housing, said insert thereby being replaceably affixed to said housing.

15. The binding apparatus of claim 11, wherein said insert comprises a member separate from said housing, said insert thereby being replaceably affixed to said housing.

16. The binding apparatus of claim 1, wherein said insert includes an arc extending longitudinally from a forward end portion to a rearward end portion, and wherein said forward end portion includes a recess therein.

17. The binding apparatus of claim 16, wherein said recess in said forward end portion of said insert is a generally longitudinally centered, laterally extending cutout.

18. The binding apparatus of claim 1, wherein said insert comprises a part which extends rearwardly and which is embedded within said housing.

19. The binding apparatus of claim 18, wherein said rearwardly extending part is generally T-shaped.

20. The binding apparatus of claim 1, wherein said insert includes an arc extending longitudinally from a forward end portion to a rearward end portion, and wherein said insert comprises a part which extends rearwardly from said rearward end portion and which is embedded within said housing.

21. The binding apparatus of claim 20, wherein said rearwardly extending part is generally T-shaped.

22. The binding apparatus of claim 1, wherein said insert includes an arc extending longitudinally from a forward end portion to a rearward end portion and further includes a pair of lateral wings extending generally rearwardly from said rearward end portion.

23. The binding apparatus of claim 22, wherein said lateral wings are generally hook-shaped.

24. The binding apparatus of claim 22, wherein said lateral wings extend at an incline, rearwardly and upwardly.

25. The binding apparatus of claim 24, wherein said bearing housing includes a rearwardly and upwardly extending ramp, and wherein said lateral wings are embedded within at least a portion of said ramp and extend at least partially along said ramp.

26. The binding apparatus of claim 1, wherein said insert includes an arc extending longitudinally from a forward end portion to a rearward end portion, wherein said forward end comprises at least one laterally extending depression.

27. The binding apparatus of claim 26, wherein said insert includes a transversely extending centerline, said at least one laterally extending depression comprises a pair of laterally extending depressions which are laterally spaced on opposite sides of said centerline.

28. The binding apparatus of claim 1, wherein said insert includes a pair of ends, and further comprising recesses within said ends.

29. The binding apparatus of claim 1, wherein said insert has an inner and outer surface, said outer surface having a plurality of depressions therein, said depressions being laterally spaced with respect to said longitudinal direction.

30. The binding apparatus of claim 29, further comprising a plurality of ribs projecting from said inner surface of said insert, wherein each of said ribs correspond to a respective one of said depressions.

31. A bearing insert for use with a cross-country binding having a longitudinal axis, said bearing insert being adapted to be embedded within a bearing housing which is adapted to be mounted on an upper surface of a ski, said insert comprising a generally arcuate inner surface extending transversely to said longitudinal axis, and means for anchoring said bearing insert within said housing, wherein said insert includes an arc extending longitudinally from a forward end portion to a rearward end portion, and wherein said forward end portion includes a recess therein, and wherein said recess in said forward end portion of said insert is a generally longitudinally centered, laterally extending cut-out.

32. The bearing insert of claim 31, wherein said insert comprises a part which extends rearwardly and which is adapted to be embedded within said housing.

33. The bearing insert of claim 32, wherein said rearwardly extending part is generally T-shaped.

34. The bearing insert of claim 31 in combination with said housing, wherein said insert includes an arc extending longitudinally from a forward end portion to a rearward end portion, and wherein said insert comprises a part which extends rearwardly from said rearward end portion and which is embedded within said housing.

35. The bearing insert of claim 34, wherein said rearwardly extending part is generally T-shaped.

36. The bearing insert of claim 31, wherein said insert includes an arc extending longitudinally from a forward end portion to a rearward end portion and further includes a pair of lateral wings extending generally rearwardly from said rearward-end portion.

37. The bearing insert of claim 36, wherein said lateral wings are generally hook-shaped.

38. The bearing insert of claim 36, wherein said lateral wings extend at an incline, rearwardly and upwardly.

39. The bearing insert of claim 38 in combination with said housing, wherein said bearing housing includes a rearwardly and upwardly extending ramp, and wherein said lateral wings are embedded within at least a portion of said ramp and extends at least partially along said ramp.

40. The bearing insert of claim 31, wherein said insert includes an arc extending longitudinally from a forward end portion to a rearward end portion, wherein said forward end comprises at least one laterally extending depression.

41. The bearing insert of claim 40, wherein said insert includes a transversely extending centerline, said at least one laterally extending depression comprises a pair of laterally extending depressions which are laterally spaced on opposite sides of said centerline.

42. The bearing insert of claim 31, wherein said insert includes a pair of lateral ends, and further comprising recesses within said ends.

43. The bearing insert of claim 31, wherein said insert has an outer surface having a plurality of spaced depressions therein.

44. The bearing insert of claim 43, further comprising a plurality of ribs projecting from said inner surface of said insert, wherein each of said ribs correspond to a respective one of said depressions.

45. A binding apparatus for affixing a cross-country ski shoe to a ski, the binding apparatus having a longitudinal direction, the shoe having mounted at a front end thereof a hinge pin having a predetermined radius of curvature, said hinge pin extending transversely to the longitudinal direction; said apparatus comprising:

a bearing housing adapted to be mounted on an upper surface of the ski, said bearing housing having a transversely extending generally arcuate inner surface and an opening positioned upwardly with respect to the ski for receiving said hinge pin, said generally arcuate inner surface of said bearing housing having a recessed portion, said recessed portion being recessed within said bearing housing by a predetermined amount; and an insert having a portion having a generally arcuate inner surface, said arcuate inner surface of said insert portion having a radius of curvature generally equal to said predetermined radius of curvature of said hinge pin, said insert having a width generally equal to said predetermined amount by which said bearing housing is recessed, said insert being affixed to said recessed portion of said inner surface of said bearing housing.

46. The binding apparatus of claim 45, further comprising means for retaining said hinge pin within said housing.

47. The binding apparatus of claim 45, wherein said bearing housing further comprises a non-recessed portion, said non-recessed portion having an inner surface, and wherein said generally arcuate inner surface of said insert is generally flush with said inner surface of said non-recessed portion of said bearing housing.

48. The binding apparatus of claim 45, wherein said arcuate inner surface of said insert portion extends from a forward zone to a rearward zone, and wherein said insert further comprises a generally planar portion extending upwardly beyond said forward zone and a generally planar portion extending upwardly beyond said rearward zone.

49. The binding apparatus of claim 45, wherein said arcuate inner surface of said insert portion extends for approximately 180 degrees.

50. The binding apparatus of claim 45, wherein said arcuate inner surface of said insert portion extends for less than 180 degrees.

51. The binding apparatus of claim 48, wherein said arcuate inner surface of said insert portion extends for approximately 180 degrees.

52. The binding apparatus of claim 48, wherein said arcuate inner surface of said insert portion extends for less than 180 degrees.

53. The binding apparatus of claim 45, wherein said housing is made from a synthetic material in a piece adapted to be fixed with respect to the ski.

54. The binding apparatus of claim 53, wherein said insert is made from a synthetic material having a greater hardness than that of said housing.

55. The binding apparatus of claim 53, wherein said insert is metallic.

56. The binding apparatus of claim 53, wherein said insert comprises a member molded with said housing.

57. The binding apparatus of claim 55, wherein said insert comprises a member molded with said housing.

58. The binding apparatus of claim 53, wherein said insert comprises a member separate from said housing, said insert thereby being replaceably affixed to said housing.

59. The binding apparatus of claim 55, wherein said insert comprises a member separate from said housing, said insert thereby being replaceably affixed to said housing.

* * * * *